US006626330B2

(12) United States Patent
Ritsche

(10) Patent No.: US 6,626,330 B2
(45) Date of Patent: Sep. 30, 2003

(54) MEDIA DISPENSER

(75) Inventor: Stefan Ritsche, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/785,679

(22) Filed: Feb. 16, 2001

(65) Prior Publication Data

US 2002/0190083 A1 Dec. 19, 2002

(30) Foreign Application Priority Data

Feb. 19, 2000 (DE) ..... 100 07 638

(51) Int. Cl.[7] ..... B67B 5/00

(52) U.S. Cl. ..... 222/153.02; 222/153.13; 222/321.9; 222/384

(58) Field of Search ..... 222/153.02, 153.13, 222/321.9, 384, 321.7

(56) References Cited

U.S. PATENT DOCUMENTS

| | | | | | |
|---|---|---|---|---|---|
| 3,779,427 | A | | 12/1973 | Ewald | 222/153 |
| 4,410,107 | A | * | 10/1983 | Corsette | 222/321.7 |
| 4,458,832 | A | * | 7/1984 | Corsette | 222/153.13 |
| 4,589,573 | A | * | 5/1986 | Tada | 222/153.13 |
| 4,773,567 | A | | 9/1988 | Stoody | 222/153 |
| 4,934,568 | A | | 6/1990 | Fuchs | 514/206 |
| 5,096,094 | A | * | 3/1992 | Guilbert | 222/153.13 |
| 5,518,147 | A | * | 5/1996 | Peterson et al. | 222/153.07 |
| 5,899,363 | A | * | 5/1999 | Bliss et al. | 222/153.02 |
| 6,065,647 | A | * | 5/2000 | Bliss et al. | 222/153.02 |

FOREIGN PATENT DOCUMENTS

| | | |
|---|---|---|
| DE | 33 16 308 A1 | 5/1983 |
| DE | 196 18 711 A1 | 5/1996 |
| WO | WO 97/32808 | 3/1997 |

* cited by examiner

*Primary Examiner*—Kevin Shaver
*Assistant Examiner*—Stephanie L Willatt
(74) *Attorney, Agent, or Firm*—Quarles & Brady LLP

(57) ABSTRACT

A dispenser (1) is provided for unlocking the stroke with two first and second handles (44, 45) configured separate from the actuator handle (5) for actuating the pump stroke. For unlocking, the first handle (44) firstly needs to be actuated in a first release direction (46). Thereafter only an actuation in a second release direction (47) is possible with the second handle (45). It is not until after this second actuation that an unlocked position is attained, which permits implementation of the pump stroke. For the second motion (47) a restrain drag (43) is furthermore provided which can only be defeated by increasing the associated actuating force.

23 Claims, 1 Drawing Sheet

MEDIA DISPENSER

TECHNICAL FIELD AND BACKGROUND OF THE INVENTION

The invention relates to a media dispenser comprising an actuator which communicates a driving force for controlling a function. For this purpose the actuator needs to be set in motion, namely by introducing a specific force for unlocking it.

The actuating force and the release force, where necessary codirectional, may be introduced manually or by drive means, such as a spring. With the actuator or the release means a stroke, such as a rotating or linear stroke, is also to be effected. The stroke may be a control movement for a valve and/or a driving movement for pressurizing the medium and also for other functions.

To ensure that the actuator cannot be moved accidentally in initiating the associated function, it is attempted to hamper and drag actuation positively or non-positively. For example, specific movement sequences or force inputs may be employed for this purpose. It is often the case that children or other unauthorized persons must not be able to actuate delivery or other functions of the dispenser.

OBJECTS OF THE INVENTION

An object of this invention is to provide a dispenser by which disadvantages of known configurations are avoided. Another object is to enable that one or more differing actuator impressions can be adequately hampered to restrict the circle of users. Still further objects are to achieve that the dispenser is compact, uncomplicated to handle and easy to assemble.

SUMMARY OF THE INVENTION

According to the invention the actuator is assigned means which in or for setting them in motion require a sequence of motions to translate the actuator from one position into another and to unlock it thereby. Although these motions may be oriented parallel or codirectional, they differ expediently from each other or from the stroke direction, however, so that in the absence of a particular manipulation skill or sufficient force no unlocking is possible. Release may be reversible or non-reversible, depending on whether a return into the locked position is provided or not.

It is particular expedient when the unlocking means are provided for releasing a positive lock. In the case of a non-positive lock it is expedient for its release that a first unlocking motion, followed by a second unlocking motion and in conclusion an actuating motion needs to be executed via the stroke. Each of the motions may be a pivoting, rotary or linear motion. Each of the motions has a direction departing from the two other motions, e.g. a radial direction, a rotary direction or a linear direction parallel to the associated rotational axis.

Due to the configuration in accordance with the invention it is possible to provide on one of the two units to be interlocked a locking element having separate first and second locking members spaced from each other and thus blocking the two unlocking motions independent of each other and counter the associated directions. If one of these locking members is released the other remains locking nevertheless. Only after the first locking member and the associated counter member have been disengaged and then moved away from each other sufficiently also the lock for the second locking member is released, after which the actuator can be moved via the stroke.

Irrespective of the positive lock as described, e.g. in a locking action solely by changing mechanical resistances during the stroke or when the locking action is provided by only one of the cited positively acting locking members, it is also of advantage to provide a support body comprising two walls or shells freely protruding counter the stroke direction. Between these support body walls a protuberance or shell, particularly the locking element of the first unit, can be moved. The protuberance is surrounded by the outer support shell in every position, an end wall in the shape of a flat ring being provided for this purpose on the outer support shell. The two shells may be integral or composed of separate components, it being particular the outer shell of the support body that consists of two layers. With this support body the casing of a valve or pump can be firmly secured to a support suitable as a helve to be enclosed by the users hand on discharging the medium and possibly being a bottle or some other hollow body. The width or radial extent of the support is larger than that of the dispenser or each of its units.

The aspects in accordance with the invention are suitable for both a reversible stroke actuation and for a once-only stroke actuation with no return stroke or a return stroke significantly shorter than the actuating stroke. In the first case the start or rest position is reattained on the return stroke and medium primed into a metering chamber of the receptacle. In the second case the metering housing contains the complete volume of medium stored so that the reservoir and the pump chamber are formed by the same space. The medium can flow through an actuator plunger to the medium outlet or the same as in a hypodermic syringe emerge directly from the cylinder opposite the plunger, the cylinder then forming the medium outlet.

The features of the invention also read from the description and the drawings and may represent advantageous aspects patentable in their own right.

BRIEF DESCRIPTION OF THE DRAWINGS

Example embodiments of the invention are explained in more detail in the following and illustrated in the drawings in which.

DETAILED DESCRIPTION

Figures 1, 2, 3, 4:
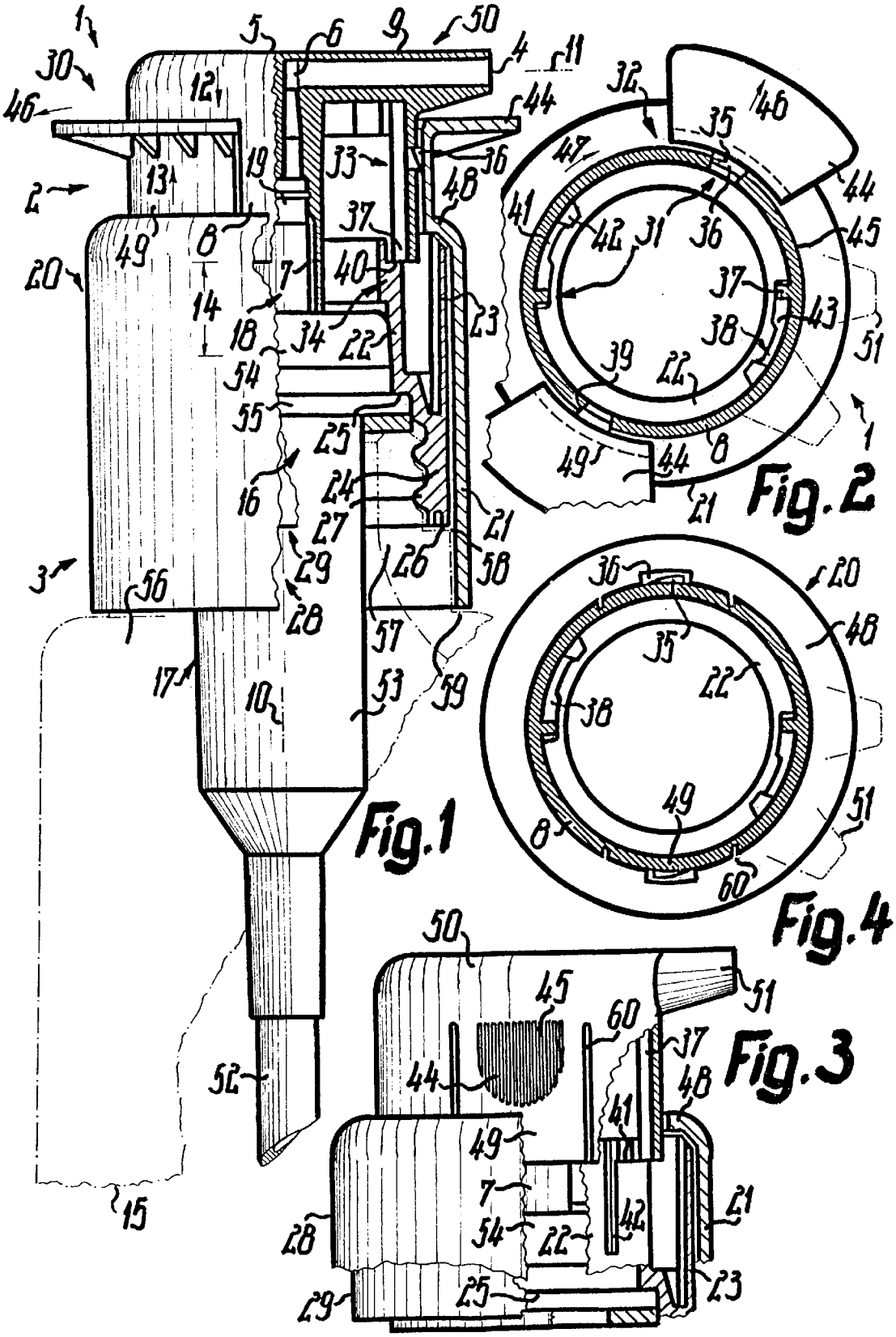
FIG. 1 is a partial section view of the dispenser in accordance with the invention in the rest position.
FIG. 2 is a cross-section through the dispenser as shown in FIG. 1, and FIGS. 3 and 4 illustrate a further aspect as shown in FIGS. 1 and 2.

The dispenser 1 is made of plastics or injection-molded parts and is devised for being held and actuated simultaneously single-handedly. It has two units 2, 3, namely the actuator unit 2 as the first unit and the supporting unit 3 as the second unit. Unit 2 comprises at a cap-shaped head 50, the medium outlet 4 open to the atmosphere as well as a handle or pressure face 5 and an outlet duct 6 porting into medium outlet 4. Outlet duct 6 traverses a stud or fastener 7 for axial assembly on a ram. Stud 7 is spacedly surrounded by a wall, a protuberance or an outermost head shell 8 of head. Shell 8 translates at its outermost end into an end wall 9 of head 50. Protruding beyond shell 8 radial outwards is solely outlet 4. Parts 5 or 7 to 9 are formed by the one-part head 50 which also bounds outlet 4 and duct 6.

All components are located in the center axis 10 of the dispenser 1 to which axis 11 of outlet 4 is oriented transverse or at right angles. The stroke 14, serving discharge of the medium and to be driven by finger pressure against handle 5, is oriented parallel to axis 10 in direction 12 whilst the return stroke is in the opposite direction 13. On the stroke the unit 2 travels into unit 3 and the dispenser 1 is shortened. The dispenser 1 with unit 3 is fixedly secured to a support 15, such as a reservoir bottle of glass, and includes one or more pumps 16. The casing 17 of the medium pump 16 protrudes into support 15 against which it is tensioned together with unit 3. Shiftingly mounted in casing 17 is a valve or piston unit 18 slideable in directions 12, 13. The ram 19 of unit 18 protrudes from the casing 17 and is fixedly secured in stud 7. Provided in casing 17 are valves, such as an inlet valve for filling the pump, respectively an outlet valve for discharging the medium into the outlet duct 6. Both valve bodies of the outlet valve may be arranged on unit 18 through which the medium flows from the metering or pump chamber into duct 6.

Unit 3 includes for its fastening to support 15 a cap-shaped support body 20 with an outermost shell or first support body wall 21 and three inner shells 22, 23, 24 which also form support body walls. Wall 21 protrudes beyond the remaining walls 22 to 24 in both directions 12, 13 and is maximally 1.5 mm thick. The innermost wall 22 centers casing 17 with axis 10. Wall 22 is surrounded over its full length and with radial spacing by shell 23 which adjoins the inner circumferential face of wall 21 or is minimally spaced away therefrom by a gap. Shell 23 protrudes in direction 13 slightly beyond wall 22. Both walls 22, 23 connect in direction 12 to shell 24 which is comparitively thicker. Shell 24 has the same outer width as shell 23 and has an inner width which is at least as large as or larger than the outer width of wall 22.

Wall 22 has at the inner circumference and spaced from shell 24 a shoulder 25 which tensions casing 17 axially against support 15. The free end of shell 24 forms an end face or shoulder 26 transversely adjoining the inner circumference of wall 21 and eventually supporting against a counter face of support 15. At its inner circumference shell 24 comprises a fastener 27, such as a thread, a radially resilient snapper, or the like, by which support body 20 engages support 15 positively locked against being pulled off. Walls 21 to 24 are formed by separate components 28, 29, namely wall 21 by the one-part component 28 and walls 22 to 24 by the one-part component 29. Head shell 8 permanently engages between walls 21, 23 and 22 and is axially spaced from shell 24 at the stroke end.

To unlock unit 2 for stroke actuation, motions differing in or increasing in resistance may be employed sequentially in direction 12 as may be produced by a return spring. It is particularly advantageous, however, when unlocking means 30 are provided for a positively acting lock 31. Means 30 comprise manual release means 32 for releasing lock 31. Lock 31 comprises a locking element 33 on unit 2 and a counter element 34 on unit 3. Locking element 33 is in one part with head 50, namely provided exclusively on shell 8. Counter element 34 is in one part with support body 20 and formed by walls 21, 22 which like the entire support body 20 could be in one part. Locking element 33 has two axially and radially staggered first and second locking members 35, 37. Counter element 34 has correspondingly staggered first and second counter members 36, 38.

First locking member 35 is an opening in shell 8 and first counter member 36 is a cam engaging member 35 with zero clearance or by a clamping action. Second locking member 37 is an axial cam, rib, key or web on the inner circumference of shell 8 and second counter member 38 is an end face. Member 35 has two locking faces 39, 40 facing each other and providing flanks of the opening. The flanks converge at an acute angle toward axis 10. Second locking face 40 is the end face of member 37. Locking faces 39, 40 are positionally fixed relative to each other and the associated faces of counter members 36, 38 are movable relative to each other only transverse to axis 10. It is, however, also conceivable to manually rotate counter members 36 with wall 21 relative to second counter member 38 and walls 22 to 24.

Counter member 38 forms on a ring sector of less than 80°, 90° or 45° an annular face 41 providing the counter face or counter shoulder. Face 41 adjoins the outer circumference of wall 22 and is set back from the free end face thereof. Thus an outer circumferential face of wall 22 protrudes transversely beyond face 41. At both ends of the circumference this circumferential face translates transversely into abutting faces for the flanks of member 37. Furthermore, face 41 adjoins the end of a slide rail 42 or groove, the one flank of which forms the one abutting face. Rail 42—as evident in FIG. 3—is provided on the outer circumference of wall 22 and is spaced from shoulder 25 in direction 13. As soon as member 37 engages inside rail 42 the head 50 is positively and without motion play prevented from rotating relative to each of parts 17, 20 to 29 of unit 3. The inner circumference of shell 8 is then closely guided on the outer circumference of wall 22.

In rest position the locking face 40 is supported by face 41 with zero clearance whilst the flanks of member 37 contact the abutting face remote from rail 42. First counter member 36 engages inside first locking member 35 with zero clearance about axis 10 and in a light clamping fit. When member 36 is moved radially outwards in a first manual motion in first release direction 46 the associated lock is released. Thus head 50 is free to rotate relative to the support body in the second release direction 47 of the second manual motion in a mode that member 37 reaches a position covering rail 42 when it is in contact with the other abutting face. It is not until then, at the end of the second manual motion, that head 50 is able to be shifted in direction 12 relative to unit 3 over stroke 14 in direction 12. After a first angle of rotation the rotational motion 47 is hampered by a catch or restrain drag 43 formed by a jut of the circumferential face adjoining face 41 transversely. The cam jut extends up to rail 42. The radially inner edge face of member 37 slides with increased friction on this jut. This edge face supports with enhanced radial tension against the circumferential face of the jut due to resilient widening of shell 8.

Provided for the two individual locks are separate handles 44, 45. First handle 44 is provided on unit 3, namely on support body 20 or wall 21. Handle 44 and wall 21 are commonly in one part. Second handle 45 is provided on unit 2 or on head 50, namely formed by the outer circumference thereof at a location where head 50 is freely exposed alongside handle 44 or axially adjacent to handle 44. Handle 44 extends about axis 10 over a partial angle of max. 70°, is a plate perpendicularly transverse to axis 10 and connects to an annular end wall 48 of wall 21 via a shell sector 49. Sector 49 is radially offset inwards relative to shell 21 and extends over the same angle as handle 44. The disk shaped end wall 48 directly connects circumferentially, entirely, directly and thus substantially dust-tight to the outer circumference of shell 8; this applying likewise to the connection of shell 8 with wall 22.

Jutting from the inner circumference is shell sector 49. Sector 49 likewise closely surrounds the outer circumference of shell 8 with its full length and thus totally conceales members 36, 35 from the exterior. Correspondingly members 37, 38 are dust-tightly covered toward the outside by wall 21. Members 35, 36 are located in the middle of the length of shell 8. Thus handle 44 is located axially directly adjacent to a stud 51 protruding radially beyond shell 8. The end of stud 51 includes medium outlet 4. Stud 51 is indicated in FIG. 2 dot-dashed in two rotational positions. As evident from FIG. 2 members 35, 37 are mutually spaced about axis 10 by an arc angle smaller or greater than 90° by 30°. The axial spacing between locking faces 39, 40 is greater than stroke 14. Shell 8 contacts only walls 22, 49, but not walls 21, 23, 24. Handle 44 and sector 49 are commonly pivotably connected to end wall 48 in a hinge axis due to it being inherently deformable. The hinge axis is oriented tangentially to axis 10. Also sector 49 is able to back springingly and inherently deform. Member 36 is located nearer to handle 44 than to the hinge. When handle 44 oriented parallel to handle 5 is urged in direction 12 it is pivoted with member 36 in direction 46.

Members and arrangements 35 to 45 are arranged multiply or paired, namely in each case two like members being distributed about axis 10 or opposing each other in a common axial plane. In the locked position as shown in FIG. 2 the stud 51 is located, as viewed axially, spacedly between two handles 44, namely in the axial plane of members 37 and thus nearer to the one handle 44. To this extent FIG. 1 shows a location of head 50 which is turned relative to member 35. Both handles 44 then require to be pressed simultaneously. This is the only way to disengage both members 36 and to allow head 50 to be rotated in direction 47 up to abutting by gripping handle 45. Stud 51 is thereby moved from the more proximate handle 44 to a location spaced from the more remote handle 44. Thereby and on the stroke members 36 slide with pressure tension on the outer circumference of shell 8 to thus be kept released. The stroke 14 is then implemented up to abutment by pressing handle 5, namely until handle 5 is spaced from handles 44 in direction 12 and is fully located between these handles 44. The users finger then seizes handle 5 between handles 44 and sectors 49 parallel to stud 50.

On stroke the piston unit 18 is synchroneously shifted and the pump chamber in casing 17 is constricted so that the medium is pressurized, the outlet valve is opened and the medium flows from the pump chamber through ram 19 pressurized into duct 6. On release of handle 5 the return stroke occurs automatically on which the outlet valve is closed, the pump chamber is expanded and the medium is resucked via a riser duct 52 from the bottom of the reservoir into the pump chamber. When head 50 is then rotated opposite to direction 47 the members 37 are distanced from the rails 42 up to abutment. In this position members 36 automatically jump into members 35. Thus the locked rest position is reattained.

Stud 7 protrudes permanently into casing 17 assembled from a longer casing part 53 and a cover 54 located in wall 22. Part 53 and cover 54 may commonly be in one part. Cover 54 is in tight contact with the inner circumference of wall 22 and has a radially protruding annularly disk shaped flange 55 against which shoulder 25 is tensioned. Support 15 has outside of the support body 20 a bulged flask 56 and a narrow neck 57. Neck 57 is located fully in support body 20 and comprises at the outer circumference the counter member for fastener 27. Tensioned against the annular end face of neck 57 is handle 44 with a washer or seal interposed and sealingly supporting against the outer circumference of casing 17. Adjoining the counter member neck 57 forms a ring shoulder 58 contacting shoulder 26. Contacting a further ring face offset in direction 12, namely the end face of wall 21 is a further annular shoulder 59. Shoulder 59 is formed by the transition between flask 56 and neck 57 to thus reliably seal the space within wall 21. However, it is just as conceivable to provide at the outer circumference of neck 57 an annular recess into which the end of wall 21 can be curved radially inwards like a crimp ring.

Referring now to FIGS. 3 and 4 it is evident that the first locking member 35 is the cam protruding from the outer circumference of head shell 8. The first counter member is a recess in the inner circumference of end wall 48 at which body 20 ends. Member 35 has only one abutting face so that head 50 is capable of being rotated out of the locked position counter direction 47 when the abutting face for second locking member 37 is omitted. Handle 44 is provided on head 50 and formed by a corresponding sector 49 of shell 8. Sector 49 is separated from the remaining shell 8 on both sides by slots 60, freely protrudes in direction 12 and is thus to be urged against axis 10 to release locking member 35. Slots 60 may also be grooves which adjoin by their flanks the outer circumference of shell 8, but extend only over a portion of the thickness of shell 8. In this case, pressing handles 44 diminishes the curvature of sector 49 with widening of the grooves and release of member 35. Member 35 is located in the middle of sector 49 as shown in FIG. 4. Not shown in FIG. 3 is the body part 53 protruding entirely into support 15.

The dispenser 1 as described is configured for dispensing pasty lotions emerging from outlet 4 as a line or blobwise. Outlet 4 may also be oriented parallel to axis 10. Outlet 4 may also be coaxial with axis 10 and face away from body 20. Outlet 4 may further form an atomizer nozzle which includes a swirl chamber. All features of all embodiments may be provided in a single embodiment, and thus all passages of the description apply for all embodiments. The features and effects may be provided precisely as described, or merely substantially or approximately so and may also greatly deviate therefrom depending on requirements.

What is claimed is:

1. A dispenser for discharging at least one medium, comprising:

an actuator for manually actuating discharge of the medium, by a discharge stroke (14) in a discharge stroke direction (12);

a first unit (2) and a second unit (3) being moveable relative to each other in a first release direction (46) and a second release direction (47);

a first lock (35, 36, 44) for locking the first unit (2) relative to second unit (3) in a locked position to prevent relative movement of said units relative to each other in the second release direction (47);

a second lock (37, 42) for locking the first unit (2) relative to the second unit (3) to prevent relative movement of said first and second units (2, 3) relative to each other in the discharge stroke direction (12);

the first lock being unlocked by a first manual motion oriented in a first release direction (46), thereby enabling the second lock to be unlocked by a second manual motion oriented in the second release direction (47), thereby enabling the actuator to be actuated to effect the discharge stroke (14) by relative manual motion of said first and second units (2, 3) in the discharge stroke direction (12);

the first release direction (46) and the second release direction (47) being different from each other;

the second lock (37, 42) being relockable by relative manual motion of said first and second units (2,3) in a direction opposite the second release direction (47) and the first lock (35, 36) being relockable by motion in a direction opposite the first release direction (46), whereby a double lock is provided again after discharge of the medium.

2. The dispenser according to claim 1, wherein said first lock (35, 36, 44) includes a locking element (35) for locking said actuator in a locked position to prevent shifting of the first unit (2) relative to the second unit (3) from a rest position in a stroke direction (12) via a stroke (14), said first lock including a counter element (34) including at least one counter member (36, 38) for engaging said locking element (33), said unlocking means (30) including release means (32) for releasing said first lock by said first and second manual motions of said locking element (33) relative to said counter element (34) in said first and second release directions (46, 47), said locking element (33) including a first locking member (35) and a second locking member (37) spaced from said first locking member (35), said first locking member (35) being lockable to prevent said second manual motion in said second release direction (47), and said second locking member (37) being lockable to prevent said stroke (14) in said stroke direction (12).

3. The dispenser according to claim 2, wherein said first locking member (35) is circumferentially spaced relative to said second locking member (37).

4. The dispenser according to claim 2, wherein said second locking member (37) is spaced relative to said first locking member (35) in said stroke direction (12).

5. The dispenser according to claim 2, wherein said first locking member (35) and said second locking member (37) are commonly made in one part.

6. The dispenser according to claim 2, wherein a first locking face (39) of said first locking member (35) is oriented transverse to a second locking face (40) of said second locking member (37).

7. The dispenser according to claim 2, wherein said counter element (34) covers said locking element (33) in said locked position on at least one side oriented substantially parallel to said stroke direction (12).

8. The dispenser according to claim 2 and further including a support body (20) for connecting said dispenser (1) to a support (15), wherein said support body (20) includes a first support body wall (21) and a second support body wall (22) spaced from said first support body wall (24), said first support body wall (21) projecting in and counter said stroke direction (12) beyond said second support body wall (22).

9. The dispenser according to claim 8, wherein said second support body wall (22) is located inside said first support body wall (21) and positionally locks a valve casing (17) delivering the medium past said first unit (2).

10. The dispenser according to claim 9, wherein said valve casing (17) is inserted into said second support body wall (22) counter said stroke direction (12) until stopped by abutting.

11. The dispenser according to claim 8, wherein said counter element (34) is provided on said support body (20).

12. The dispenser according to claim 8, further including a first counter member (36) on said first body wall (21) for locking said first locking member (35) and a second counter member (38) on said second support body wall (22) for locking said second locking member (37).

13. The dispenser according to claim 8, wherein said first support body wall (21) includes an annular end wall (48) and an inner circumference including one of said at least one counter member (35).

14. The dispenser according to claim 8, wherein said second support body wall (22) and one of said at least one counter member (38) commonly include an annular face (41) for locking said locking member (37), said annular face (41) including a partial sector adjoining to a slide rail (42) receiving said second locking member (37) when moving along said stroke (14).

15. The dispenser according to claim 8, wherein said first support body wall (21) includes an inner circumference and a fastener (27) for attaching said support body (20) to said support (15), said first support body wall (21) including an annular shoulder (59) displaced relative to said counter element (34) and said fastener (27) in said stroke direction (12).

16. The dispenser according to claim 2, wherein said first unit (2) and said actuator commonly include an actuator head (50) including a manually actuatable pressure face (5), a medium outlet (4) porting into an environmental open and a head shell (8), said head shell (8) including said locking element (33) and protruding in said stroke direction (12) into said second unit (3).

17. The dispenser according to claim 16, wherein said second locking member (37) is formed by a free shell end of said head shell (8).

18. The dispenser according to claim 2, wherein when in said rest position said first unit (2) is surrounded by said second unit (3) in the vicinity of said locking element (33) to provide a substantially dust-tight seal.

19. The dispenser according to claim 1, wherein said first lock (35, 36, 44) includes at least one release handle (44, 45) for releasing the first lock in a sequence before the second lock.

20. The dispenser according to claim 19, wherein said first unit (2) includes said at least one release handle (44, 45).

21. A dispenser for discharging media comprising:

an actuator for manually actuating discharge of the medium by a discharge stroke (14) in a discharge stroke direction (12);

a first unit (2) and a second unit (3) being moveable relative to each other in a first release direction (46) and a second release direction (47);

a first lock (35, 36) for locking the first unit (2) relative to second unit (3) in a locked position to prevent relative movement of said first and second units (2, 3) relative to each other in the second release direction (47);

a second lock (37, 42) for locking the first unit (2) relative to the second unit (3) to prevent relative movement of said first and second units (2,3) relative to each other in the discharge stroke direction (12);

wherein unlocking means (30) are included for unlocking said first and second locks and the actuator by a sequence of manual motions (46, 47), said manual motions including a first manual motion oriented in the first release direction (46) and a second manual motion oriented in the second release direction (47);

the first and second release directions (46, 47) being different from each other;

said locks (35, 36) including a locking element (35) for locking said actuator in a locked position to prevent shifting of the first unit (2) relative to the second unit (3) from a rest position in a stroke direction (12) via a stroke (14);

said lock including a counter element (34) including at least one counter member (36, 38) for engaging said locking element (33);

said unlocking means (30) including release means (32) for releasing said lock (31) by said first and second manual motions of said locking element (33) relative to said counter element (34) in said first and second release directions (46, 47);

said locking element (33) including a first locking member (35) and a second locking member (37) spaced from said first locking member (35);

said first locking member (35) locking said second manual motion against said second release direction (47);

said second locking member (37) locking said stroke (14) against said stroke direction (12), said first unit (2) and said actuator commonly include an actuator head (50) including a manually actuatable pressure face (5), a medium outlet (4) porting into an environmental open and a head shell (8);

said head shell (8) including said locking element (33) and protruding in said stroke direction (12) into said second unit (3); and said first locking member (35) adjoining an outer circumference of said head shell (8).

22. A dispenser for discharging media comprising:

an actuator for manually actuating discharge of the medium by a discharge stroke (14) in a discharge stroke direction;

a first unit (2) and a second unit (3) being moveable relative to each other in a first release direction (46) and a second release direction (47);

a first lock (35, 36) for locking the first unit (2) relative to second unit (3) in a locked position to prevent relative movement of said first and second units (2, 3) relative to each other in the second release direction (47);

a second lock (37, 42) for locking the first unit (2) relative to the second unit (3) to prevent relative movement of said first and second units (2,3) relative to each other in the discharge stroke direction (12);

wherein unlocking means (30) are included for unlocking said first and second locks and the actuator by a sequence of manual motions (46, 47), said manual motions including a first manual motion oriented in the first release direction (46) and a second manual motion oriented in the second release direction (47);

the first and second release directions (46, 47) being different from each other;

said unlocking means including at least one release handle (44, 45) for releasing by said sequence a first lock and a second lock;

said at least one release handle (44) being provided for releasing both said first lock (35, 36) and subsequently said second lock (37, 38).

23. A dispenser for discharging media comprising:

an actuator for manually actuating discharge of the medium by a discharge stroke (14) in a discharge stroke direction;

a first unit (2) and a second unit (3) being moveable relative to each other in a first release direction (46) and a second release direction (47);

a first lock (35, 36) for locking the first unit (2) relative to second unit (3) in a locked position to prevent relative movement of said first and second units (2, 3) relative to each other in the second release direction (47);

a second lock (37, 42) for locking the first unit (2) relative to the second unit (3) to prevent relative movement of said first and second units (2,3) relative to each other in the discharge stroke direction (12);

wherein unlocking means (30) are included for unlocking said first and second locks and the actuator by a sequence of manual motions (46, 47), said manual motions including a first manual motion oriented in the first release direction (46) and a second manual motion oriented in the second release direction (47);

the first and second release directions (46, 47) being different from each other;

said locks (35, 36) including a locking element (35) for locking said actuator in a locked position to prevent shifting of the first unit (2) relative to the second unit (3) from a rest position in a stroke direction (12) via a stroke (14);

said lock including a counter element (34) including at least one counter member (36, 38) for engaging said locking element (33);

said unlocking means (30) including release means (32) for releasing said lock (31) by said first and second manual motions of said locking element (33) relative to said counter element (34) in said first and second release directions (46, 47);

said locking element (33) including a first locking member (35) and a second locking member (37) spaced from said first locking member (35);

said first locking member (35) locking said second manual motion against movement in said second release direction (47);

said second locking member (37) locking said stroke (14) against movement in said stroke direction (12); and said dispenser (1) defining a center axis (10) oriented substantially parallel to said stroke direction (12), said first manual motion (46) oriented transverse to said center axis (10) and said second manual motion (47) being a rotary motion of less than 180° about said center axis (10), said first locking member (35) being displaced about said center axis (10) relative to said second locking member (37).

* * * * *